United States Patent [19]

Nimmons

[11] Patent Number: 4,633,531

[45] Date of Patent: Jan. 6, 1987

[54] TENSION MOUNTING FOR FACE GUARD

[75] Inventor: Kenneth W. Nimmons, Litchfield, Ill.

[73] Assignee: Schutt Manufacturing Co., Inc., Litchfield, Ill.

[21] Appl. No.: 730,357

[22] Filed: May 3, 1985

[51] Int. Cl.[4] ..... A41D 13/00; A42B 3/00

[52] U.S. Cl. ..... 2/424; 2/9

[58] Field of Search ..... 2/9, 424, 10

[56] References Cited

U.S. PATENT DOCUMENTS

| | | | |
|---|---|---|---|
| 3,139,624 | 3/1963 | Humphrey . | |
| 3,263,236 | 9/1964 | Humphrey . | |
| 3,729,746 | 5/1973 | Humphrey | 2/9 |
| 4,370,759 | 2/1983 | Zide | 2/9 X |
| 4,390,995 | 7/1983 | Walck | 2/9 |

OTHER PUBLICATIONS

NOCSAE Football Faceguard Standard, Voigt Hodgson, dated Apr. 6, 1983.

*Primary Examiner*—Peter Nerbun

*Attorney, Agent, or Firm*—Anthony Niewyk; John F. Hoffman

[57] ABSTRACT

A mounting system for mounting a face guard on a football helmet, wherein the face guard is able to pivot about a horizontal axis about the top portion of the helmet. The improved mounting arrangement includes a pair of straps in the form of loops which enclose wire segments of the face guard. The straps are mounted to be in tension when the face guard encounters a frontal force. The straps are comprised of a resilient polyurethane material and are dimensioned so that most of the shock force encountered by the face guard due to blows thereon is absorbed by the tension mounted straps. The straps include a tapered end portion and an enlarged neck portion to provide sufficient resiliency yet sufficient rigidity to protect the player and to prevent the face guard from being permanently distorted. The head portions of the straps are dimensioned so that the face guard, in case of an injury to the player, can be pivoted past the head portions about the horizontal axis without distortion of the face guard. Since the face guard is mounted sufficiently far back on the helmet, a universal size face guard can be utilized.

6 Claims, 10 Drawing Figures

PRIOR ART

TENSION MOUNTING FOR FACE GUARD

BACKGROUND OF THE INVENTION

This invention pertains to a football helmet, and in particular to the face guard mounting assembly of a football helmet.

A primary consideration in mounting a face guard to a football helmet is the protection of the player from facial injury. The face guard is generally comprised of a grid-like arrangement of wire segments which are coated with a resilient plastic-like material. The face guard covers the player's face so that the face guard and the helmet will absorb the blows and shocks caused by player contact and will protect the player's face from injury. Since forceful shocks must be absorbed by the face guard, it is imperative that the face guard is securely attached to the helmet and that the blows and shocks received by the face guard will not be transmitted to the player but will be absorbed by the face guard, the face guard mounting assembly and the helmet assembly. Additionally, it is important that the entire face guard mounting assembly is resilient so that strong blows will not break the face guard loose from the helmet. It is therefore desirable to provide a resilient mounting arrangement for a football helmet face guard wherein the mounting arrangement absorbs the shocks imparted to the face guard.

In prior art face guard mounting assemblies a problem has been encountered in that the face guard would distort under the impact of heavy blows thereto. The blows received by the face guard in these arrangements are absorbed not only by the helmet and the mounting assemblies, but are also absorbed by the wire material of the face guards which are distorted by these forces. If a mounting assembly does not absorb enough of the shock forces, the forces will be absorbed by the face guard itself and cause permanent distortion therein. This has the disadvantage that the face guard must periodically be replaced. When very large football players use football helmets with these types of face guard mounting assemblies, the face guards must often be replaced after each game. When the face guard takes on permanent distortion it also tends to distort the plastic helmet shell in a lateral direction. The distorted helmet will cause an improper and loose fit to the players head. It is therefore desirable to provide a mounting arrangement for a football helmet face guard wherein the face guard will not permanently distort under the impact of blows thereto.

Another consideration in the mounting of a face guard to a football helmet is the proper fit. The face guard should be streamlined so as to follows the contours of the helmet shell thereby reducing any catching and snagging points.

In the design of a football helmet and the mounting assembly of a face guard therefor, it is important that the helmet is easy to place on the player's head and is easily removed therefrom. This is especially true in case of injury, when it is important that the face guard can be removed without disturbing the position of the helmet on the player's head. It is therefore desirable to provide a face guard mounting assembly for a helmet wherein the face guard can be pivoted away from the player's face.

Since human heads, and therefore football helmets, vary considerably in size it has been necessary with the prior art face guards to stock a variety of sizes of face guards to match the helmets. However, this entails additional expense and is therefore undesirable. It is therefore desired to provide a face guard mounting assembly which permits a universal size face guard to be used with a variety of helmet sizes.

Two prior art patents which disclose mounting systems for mounting a face guard to a football helmet are U.S. Pat. Nos. 3,139,624 and 3,263,236. In both of these patents a face guard mounting system is disclosed wherein the face guard is mounted to the top of the helmet and wherein the face guard can pivot about the mounting devices and swing away from the face of the player. In U.S. Pat. No. 3,139,624 an arrangement is provided wherein a bumper is provided against which a wire member of the face guard is positioned. The bumper will be compressed under the action of shock forces to the face guard. The bumper is resilient so that shock forces and blows to the face guard will be absorbed by the bumper. However, in use the face guard will spread away laterally from the helmet under the impact of heavy blows and will permanently distort. The lateral movement of the face guard also pulls the helmet shell in a lateral direction. This distorts the helmet shell and does not allow a proper fit to the players head. Therefore, the face guard will need to be replaced periodically. Additionally, in this assembly, the face guard is mounted a substantial distance forward of the ear holes so that with this arrangement a variety of face guard sizes must be made available to match the different helmets sizes.

U.S. Pat. No. 3,263,236 discloses a resilient mounting assembly including a clamp or resilient strap. As can be seen from this patent, the arrangement has the same disadvantage as the arrangement disclosed in U.S. Pat. No. 3,139,624 in that the clamps or straps will be in compression under the impact of frontal blows to the face guard. The face guard will tend to move laterally away from the vertical sides of the helmet and will tend to assume a permanently distorted position. The distorted face guard will tend to pull the helmet shell in a lateral direction. This distorts the helmet shell and does not allow a proper fit to the player's head. Additionally, the straps or clamps will tend to roll over backwardly under the impact of the distorting forces. The mounting location of the face guard to the helmet requires the matching of a properly sized face guard for a particular helmet size, so that no universal face guard size can be used.

In some prior art helmet assemblies, the strap-like structure which has been provided for mounting the face guard to the helmet in a compression mode has been built up at the head of the strap where the strap attaches to the helmet to provide the face guard with a bumper. These bumpers must be resilient and must be made relatively thick to aid in absorbing the compression forces generated by blows on the face mask. The strap bumper portions require additional material to manufacture, and furthermore do not function satisfactorily in absorbing the shock forces. When strong blows are encountered by the face guard, the stresses on the face guard will tend to cause the face guard to spread and separate laterally away from the helmet. This is particularly true because of the forward mounting of the face guard to the helmet at the point where the sides of the helmet are tapered. Since the face guard must conform to this taper it will have a natural inclination to move laterally away from the helmet, thus pulling the helmet shell in the same lateral direction. It is therefore desirable to provide a mounting system for a helmet wherein the mounting device is in tension and wherein a universal face guard size can be used.

SUMMARY OF THE INVENTION

The present invention, in one form thereof, overcomes the disadvantages of the above-described prior art face guard mounting systems by providing an improved mounting system therefor. In the mounting arrangement of the present invention the face guard is mounted to the side of the helmet by means of a pair of straps which are in tension when the face guard is subjected to frontal blows or shocks.

The present invention, in one form thereof, comprises an improvement in a mounting assembly for mounting a face guard to a football helmet whereby the face guard is pivotally mounted to the top of the helmet and wherein two straps are mounted to the side of the helmet in such a manner that the face guard is secured further back on the helmet than was the case in prior art arrangements. The mounting straps are constructed of a resilient material and are dimensioned in such a way that the straps are not too stiff nor too resilient. The straps include a tapered portion which aids in providing proper resiliency and flexibility to the straps thereby permitting them to absorb the shocks encountered by the face guard.

An advantage of the mounting arrangement according to the present invention is that shocks and blows to the face guard do not result in distortion of the face guard, but instead are absorbed in the mounting straps. Another advantage of the mounting arrangement of the present invention is that helmet distortion due to face guard distortion and spreading is minimized.

Yet another advantage of the mounting arrangement according to the present invention is that the face guard can be easily moved away from the helmet in case of injury to the player by pivoting the face guard about a horizontal axis.

Still another advantage of the face guard according to the present invention is that it permits the utilization of a universal or common size face guard with a variety of helmet sizes.

It is an additional advantage of the face guard mounting system according to the present invention that the face guard is mounted more closely to the sides of the helmet thereby streamlining the assembly and minimizing the catching potential found in contact sports.

A yet further advantage of the present invention is that the shocks and blows encountered by the face guard are not transmitted to the helmet but instead are absorbed by the mounting straps.

Still another advantage of the present invention is that the amount of material necessary to make the straps is less than that necessary for manufacturing prior art mounting straps having large bumper sections.

A still further advantage according to the present invention is that the mounting holes for mounting the straps to the helmet are the same as the mounting holes used for the prior art compression mounted straps so that no additional mounting holes need to be drilled in existing helmets if the face guard mounting assembly according to the present invention is used therewith.

The invention, in one form thereof, comprises an improvement in mounting a face guard to a football helmet including a plurality of mounting means for attaching the sides of the guards to the sides of the helmet, the mounting means being in tension when the guard encounters a frontal force. The face guard sides are attached to the mounting means at points spaced a distance in the range of 1.5 inches to 2.0 inches from the centers of the ear holes. The mounting means includes head portions, the head portions dimensioned in a direction perpendicular to the surface of the helmet a distance sufficiently small to permit the guard to clear the head portions without distorting the guard when the guard is pivoted about the horizontal axis.

The invention, in one form thereof, comprises an improvement in mounting a grid-like face guard to a football helmet including a pair of ear holes in the sides of the helmet. The improvement comprises a plurality of strap means for mounting the guard to the sides of the helmet, each strap comprising two overlapping end portions to form a loop. A first of the end portions is tapered in a lengthwise direction of the strap means and a second of the end portions has a thickened head portion including a recess for housing the head of a fastener which is used for securing the strap means to the helmet at attachment points thereon. The centerline of the wire members which are secured to the helmet by the straps are spaced from the surface of the helmet at the attachment points a distance in the range of 0.300 inches to 0.380 inches. The straps are mounted and dimensioned to stretch and to absorb shock forces from the guard.

It is an object of the present invention to provide a mounting arrangement for a football helmet face guard comprising resilient mounting straps which are in tension to absorb shocks or blows encountered by the face guard.

It is another object of the present invention to provide a football helmet face guard mounting system wherein the face guard distortion is limited under the impact of blows and shocks thereto.

A further object of the invention is reduced helmet distortion due to face guard spreading.

Yet another object of the present invention is to provide a mounting system for the face guard of a football helmet which protects the player yet is simple and inexpensive to manufacture.

A still further object of the present invention is to provide a mounting arrangement for a football helmet face guard wherein the face guard is easily removable in case of injury to the player.

Still another object of the present invention is to provide a mounting system for a football helmet face guard which permits the use of a universal size face guard with different helmet sizes.

A still further object of the present invention is to provide a streamlined football helmet face guard mounting assembly with reduced catching and snagging points.

BRIEF DESCRIPTION OF THE DRAWINGS

The above mentioned and other features and objects of the invention and the manner of attaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF A PREFERRED EMBODIMENT

Figure 7:
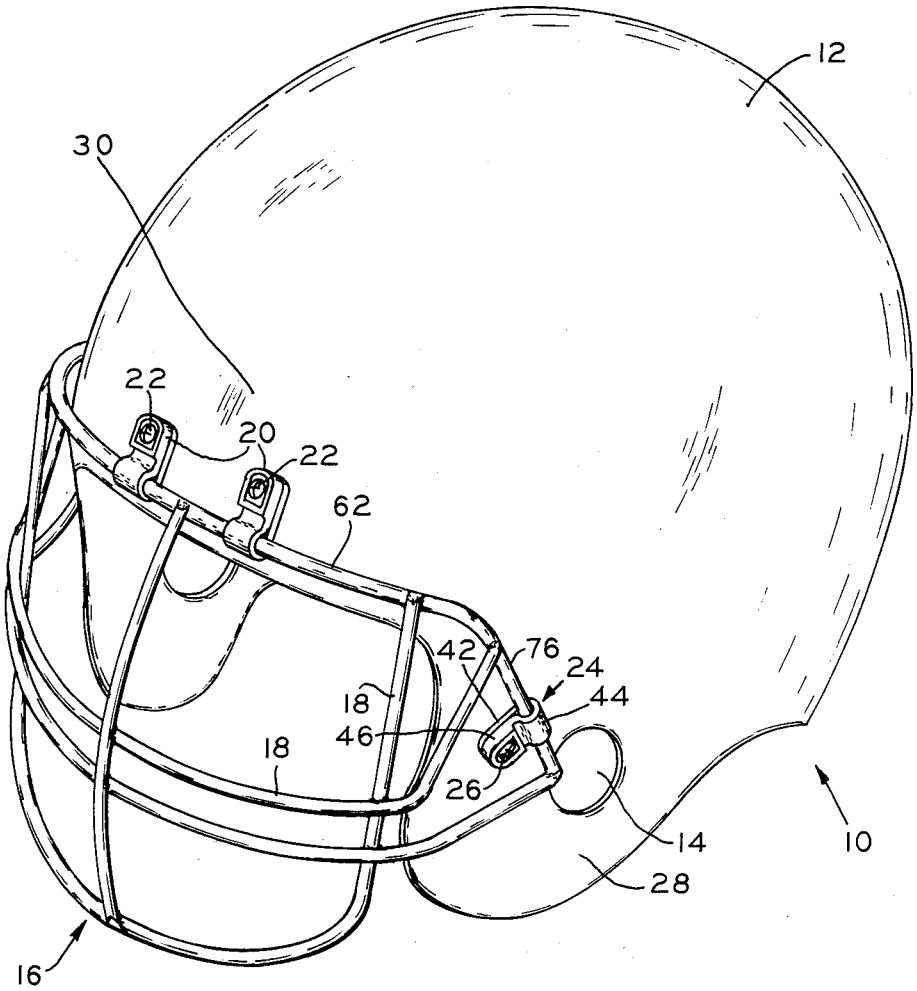
FIG. 7 is a perspective view of a helmet showing the attachment of the face guard to the helmet.

Referring to FIG. 7, a helmet assembly 10 is shown including a helmet 12 having ear holes 14. The helmet is preferably constructed of a strong rigid plastic material. A face guard 16 is shown constructed of a plurality of wire segments 18 arranged in a grid-like pattern and secured together as by welding. The wire members are preferably covered with a resilient plastic material.

Face guard 16 is attached to top 30 of helmet 12 by means of a pair of mounting members 20 including fasteners 22. Face guard 16 is attached to the vertical side portions 28 of helmet 12 by means of mounting members 24 which are secured to the helmet by fasteners 26 as further explained hereinbelow.

Figure 1:
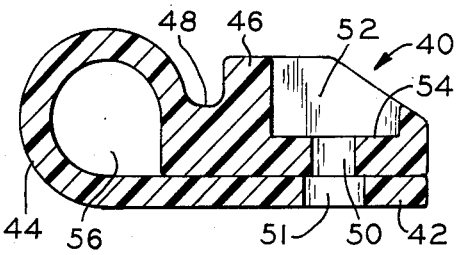
FIG. 1 PRIOR ART
FIG. 1 is a sectional elevational view of prior art mounting strap.

Referring now to FIG. 1 a prior art mounting member 40 is disclosed. Mounting member 40 is formed in the shape of a strap having a relatively thick strap end 42 and loop portion 44. The end of the strap opposite end 42 is formed with an enlarged section 46 shaped as a bumper and including a neck portion 48 which connects bumper 46 to loop portion 44. A recess 52 is provided in bumper 46 for concealing the head of a fastener in apertures 50 and 51. The head of the fastener engages shoulder 54 in recess 52. Aperture 51 in strap end 42 is larger in diameter than aperture 50 for engagement with a T-nut as further explained hereinbelow.

Bumper portion 46 is relatively thick since this prior art mounting member 40 is mounted in compression as disclosed in U.S. Pat. No. 3,263,236, which patent is incorporated herein by reference. Therefore, as loop 44 envelopes a wire member of face guard 16 and as the face guard is subjected to a blow or a frontal force, the forces will be transmitted backward and to the right as viewed in FIG. 1 and will be absorbed by resilient bumper 46. If a very heavy blow or force is encountered, loop portion 44 will tend to roll over onto bumper portion 46. This is undesirable since it causes the face guard portion enclosed in loop 44 to move laterally away from the sides of the helmet and to be distorted and in turn to distort the helmet laterally. For this reason, bumper portion 46 has been built up to be relatively thick to prevent loop portion 44 from rolling over onto bumper 46.

Figure 2:
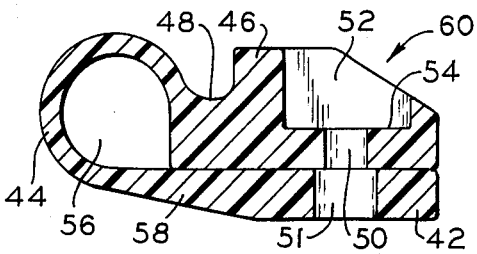
FIG. 2 is a sectional elevational view of another prior art mounting strap.

Referring now to FIG. 2 another prior art mounting member 60 is shown of generally the same configuration as the prior art mounting member of FIG. 1. However, in this mounting member the strap end portion 42 has been thickened and is connected to loop 44 by means of a tapered portion 58. Tapered portion 58 will add further stiffness to the mounting member whereby the loop 44 is less likely to roll over onto bumper 46 when the face guard encounters frontal forces or blows thereon.

Figure 3:
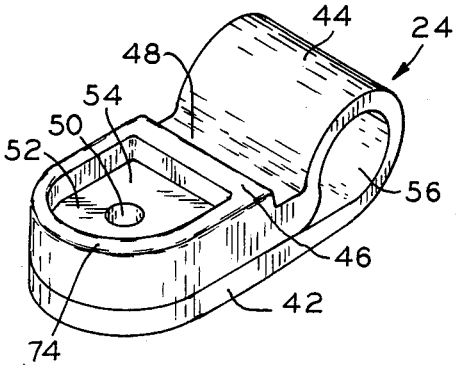
FIG. 3 is a perspective view of a mounting strap according to the present invention.
Figure 4:
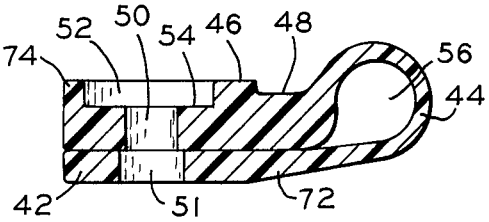
FIG. 4 is a sectional elevational view of the mounting strap of FIG. 3.
Figure 5:
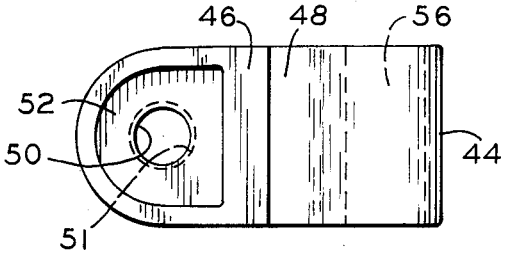
FIG. 5 is a plan view of the mounting strap of FIG. 3.

Referring now to FIGS. 3–5 a mounting member 40 according to the present invention is disclosed including a loop portion 44, a first strap end portion 42, a second strap end portion 46 and a neck portion 48. A recess 52 is again provided in strap end portion 46 for housing the head of a fastener 26 for securing the mounting member to the side of the helmet. Aperture 51 in strap end 42 is aligned with aperture 50 in strap end 46 and with recess 52. Aperture 51 is greater in diameter than aperture 50 for engagement with a T-nut as further explained hereinafter.

Figure 6:
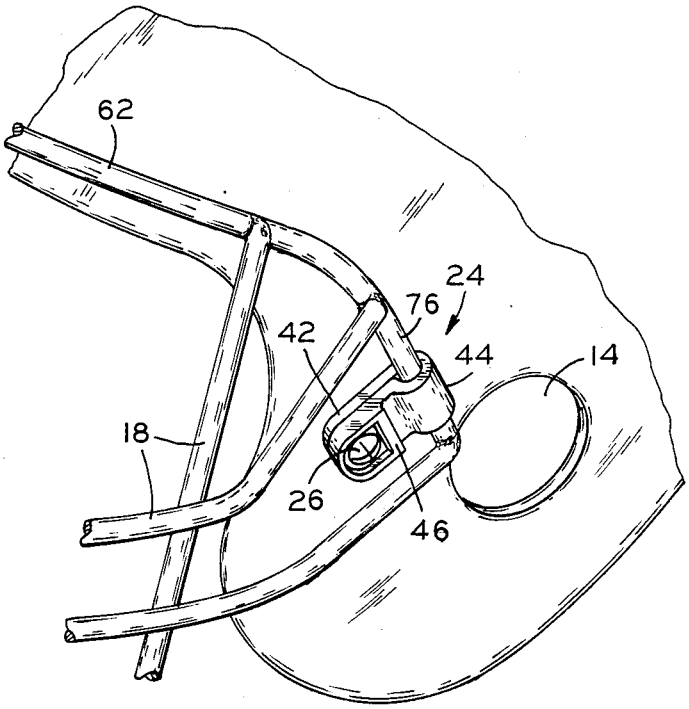
FIG. 6 is an enlarged fragmentary perspective view showing the attachment of the mounting strap and the face guard to the helmet.

Referring now to FIG. 6, it can be seen that mounting member 24 is mounted in a tension mode with the loop portion 44 closer to ear hole 14 than strap end member 42 and strap end member 46. Thus, as a forward blow or force is encountered by the face guard, member 76 will be forced backward thus tending to stretch resilient mounting member 24.

Referring now again to FIGS. 3–5 it can be seen that the head or bumper portion 46 is of substantially less thickness than bumper portion 46 of the prior art mounting members shown in FIGS. 1 and 2. The reason for this configuration is that head 46 in member 24 according to the present invention is not in compression and does not need to be thick to absorb compression shock forces. Secondly, if an injury occurs to a player and the helmet cannot be readily removed, it is sometimes necessary to remove the face guard. With the tension mounting arrangement of the present invention, what would then be necessary is that loop 44 be slit with a sharp instrument such as a knife so that the helmet face guard can be rotated about the horizontal axis of bar 62 and can be swung away from the helmet to allow access to the face of the player. If bumpers 46 were thick, the face guard could not be swung past them without distorting the face guard, or the helmet sides 28 which is undesirable. The head portion 46 is therefore dimensioned so that face guard 16 can be swung past mounting members 24 without distortion. In a preferred embodiment, the thickness of head portion 46 is in the range of 0.245 inches to 0.255 inches.

Referring further to FIG. 4, it can be seen that loop portion 44 has an aperture 56 which is smaller than that of the apertures 56 of the prior art mounting member configurations of FIGS. 1 and 2. The purpose for this is that with a smaller aperture 56, the centerline of the aperture, and therefore the centerline of the wire member 76 which is enclosed therein, will be more closely spaced to the side of the helmet than would be the case if a large loop aperture 56 were provided such as in the prior art configurations of FIGS. 1 and 2. By having the centerlines of face guard members 76 closely spaced to the helmet sides, the helmet assembly is streamlined, thereby reducing any catching and snagging points.

Referring further to FIGS. 3, 4 and 5, it can be seen that mounting member neck portion 48 which connects head portion 46 to loop portion 44 has been widened whereby additional material is available for absorbing shock forces since portion 48 can stretch. The dimension of neck portion 48 in the lengthwise direction of strap 24 in a preferable embodiment would be in the range of 0.188 inches to 0.219 inches.

Referring again to FIG. 4, it can be seen that a tapered portion 72 is provided between strap end portion 42 and loop portion 44. This tapered portion is provided to give strap 24 flexibility to allow it to absorb shock forces.

Mounting member 24 is preferably constructed of a polyurethane material of appropriate tensile strength. A tensile strength in the range of 6000 psi to 6500 psi has proven to be acceptable for a mounting member of the disclosed configuration. Preferably the material will be clear in color so that the mounting member can be used on helmets having a variety of colors.

Figure 10:
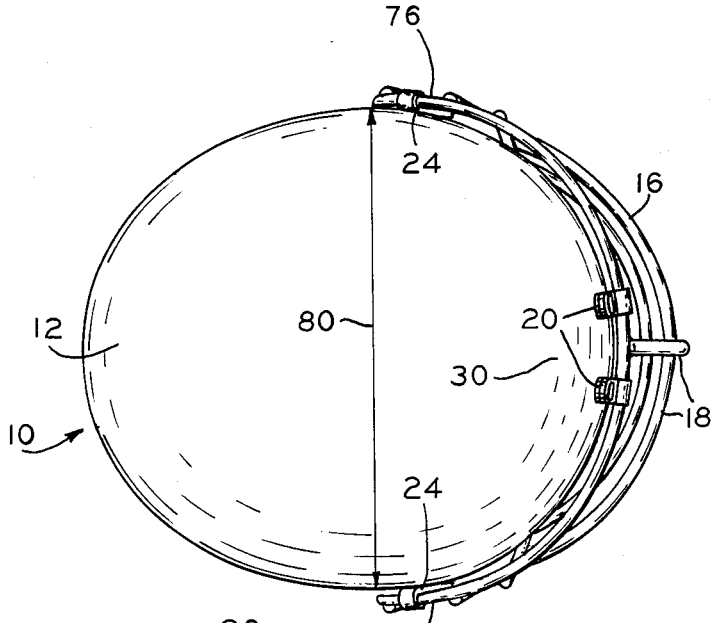
FIG. 10 is a plan view of the helmet and face guard assembly.

By referring to FIGS. 7 and 10, it can be seen that the point at which mounting bar member 76 is attached is located further back on the helmet than was the case in the prior art face guard mounting arrangements. The reason for this is that the face guard mounting members 24 according to the present invention are in tension rather than in compression. By using the same helmet mounting holes for fasteners 26 as were used with the prior art compression mounting arrangements, and by mounting members 24 in a reverse tension mode with the loop portions located toward the back of the helmet, the front to back face guard dimension must be longer for face guards used with the present face guard mounting arrangement. By referring to FIG. 10, it can be seen that with this mounting arrangement the face guard spans the distance 80 which is the greatest width available in the helmet. This is advantageous since it has been found that the greatest width dimension of human heads is fairly constant, whereas human heads vary substantially in the front to back dimension. Therefore, by mounting the face guard 16 further back on the helmet, it is possible to use a uniform or common size for face guards for a variety of helmet sizes. Therefore, the helmet manufacturer, dealer, school, or team equipment manager does not need to stock a number of face guards in a variety of sizes for a variety of helmet sizes as was necessary in the past. It has been found that by measuring from ear holes 14, which have a standard location in helmets, the attachment point for wire members 76 to strap 24 should be located within an arc of 1.5 inches to 2.0 inches as measured from the center of the ear holes. Members 76 are preferably inclined at a 45° angle as shown.

An advantage of attaching the face guard in this fashion is that existing helmets can be retrofitted with the improved mounting members 24 of the present invention by using the same mounting holes in the helmet as were used for prior art mounting arrangements.

Figure 8:
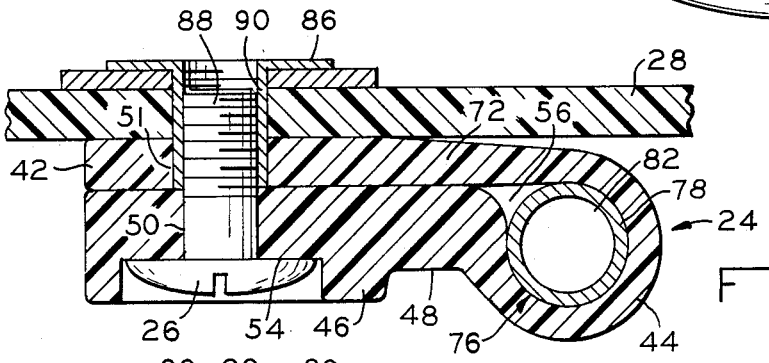
FIG. 8 is an enlarged fragmentary sectional view of the mounting strap attachment to the helmet.
Figure 9:
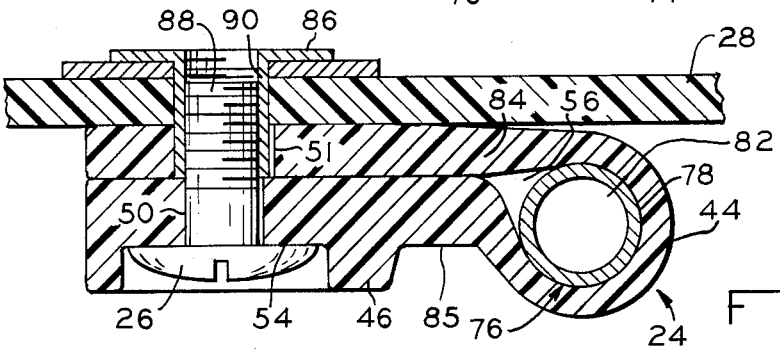
FIG. 9 is a fragmentary sectional view showing the attachment of the mounting strap to the helmet when impact forces are transmitted to the mounting strap.

Referring now to FIGS. 8 and 9, what is disclosed is an enlarged sectional view of the mounting strap in the normal or undistorted state as shown in FIG. 8 and in the stretched or dynamic state as shown in FIG. 9. Mounting member 24 is shown enclosing a wire mounting segment 76 of face guard 16 constructed of wire 82 having a resilient coating 78. Loop member 44 surrounds wire mounting member 76. Fastener 26 is shown and comprises a screw-type fastener or the like having a slotted head and a threaded portion 88 for engaging with a T-nut 86. Aperture 51 in strap end portion 42 is of a larger diameter than aperture 50 in head portion 46 since the shaft of T-nut 86 has a greater diameter than threaded portion 88 of fastener 26. It can be seen that the center of aperture 56 and loop 44, and therefore the center of wire portion 76, is relatively close to the surface of helmet side 28 as compared with the prior art mounting members of FIGS. 1 and 2 thereby streamlining the assembly. It can also be seen that as a tensile force is encountered by mounting member 24, neck portion 48 and tapered portion 72 can stretch, whereby tapered portion 72 and neck portion 48 will stretch as shown by numerals 84 and 85 in FIG. 9. Therefore, most of the shock forces caused by blows to the helmet face guard will be absorbed by mounting member 24 and will not be transmitted from the face guard to the helmet, thereby protecting the player.

It can also be seen that by making the head portion 46 of number 24 smaller than in the prior art mounting members shown in FIGS. 1 and 2, the amount of material necessary to manufacture the mounting member is reduced.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. In a helmet including a pair of ear holes and a grid-like face guard, first mounting means for attaching the guard to the front of a helmet and for permitting said guard to pivot about a horizontal axis away from said helmet, the improvement comprising:

a plurality of second mounting means for attaching the sides of said guard to the sides of said helmet, said second mounting means being in tension when said guard encounters a frontal force, the sides of said guard being attached to said second mounting means at points spaced a distance in the range of 1.5 inches to 2.0 inches from the centers of said ear holes, said second mounting means including a head portion, said head portion being dimensioned in a direction perpendicular to the surface of said helmet a distance sufficiently small to permit said guard to clear said head portion without distortion of said guard when said guard is disengaged from said plurality of second mounting means and is pivoted about said horizontal axis.

2. The helmet according to claim 1 wherein each said second mounting means includes a strap means, said strap means including a loop for encircling a wire member of said guard, the centerline of said loop spaced from the surface of said helmet a distance in the range of 0.300 inch to 0.380 inch.

3. The helmet according to claim 1 wherein the second mounting means is formed of a polyurethane material with a tensile strength in the range of 6000 psi to 6500 psi.

4. The helmet according to claim 2 wherein said mounting means includes a neck portion interconnecting said head portion and said loop, the length of said neck portion in the direction from said head to said loop being in the range of 0.188 inches to 0.219 inches.

5. The helmet according to claim 2 wherein said second mounting means is formed of clear polyurethane.

6. The helmet according to claim 1 wherein said second mounting means includes a loop portion, the portion of said loop opposite said head portion being tapered in the lengthwise direction of said strap.

* * * * *